US006643871B1

(12) United States Patent
Robke

(10) Patent No.: US 6,643,871 B1
(45) Date of Patent: Nov. 11, 2003

(54) ARTICLE OF BEDDING

(76) Inventor: Kevin G. Robke, P.O. Box 164 R.R. #1, Seneca, KS (US) 66538-0164

( * ) Notice: Subject to any disclaimer, the term of this patent is extended or adjusted under 35 U.S.C. 154(b) by 0 days.

(21) Appl. No.: 10/136,982

(22) Filed: May 1, 2002

(51) Int. Cl.[7] ..... A47G 9/04; A47G 9/02
(52) U.S. Cl. ..... 5/486; 5/482
(58) Field of Search ..... 5/486, 482, 495, 5/496, 498, 502, 923

(56) References Cited

U.S. PATENT DOCUMENTS

| | | | | | |
|---|---|---|---|---|---|
| 2,689,961 | A | * | 9/1954 | Lieberthal | 5/486 |
| 2,730,728 | A | * | 1/1956 | Roberts | 5/486 |
| 3,072,776 | A | * | 1/1963 | Quenneville | 5/486 |
| 3,530,516 | A | * | 9/1970 | Marquette | 5/486 |
| 4,005,499 | A | * | 2/1977 | Klein | 5/486 |
| 6,311,347 | B1 | * | 11/2001 | Limardi et al. | 5/482 |

FOREIGN PATENT DOCUMENTS

| | | | | |
|---|---|---|---|---|
| FR | 2569096 | * | 2/1986 | 5/486 |
| FR | 2618660 | * | 7/1987 | 5/486 |

* cited by examiner

*Primary Examiner*—Alexander Grosz
(74) *Attorney, Agent, or Firm*—Steven G. Roeder

(57) ABSTRACT

An article of bedding (228) for a bed (12) includes a flexible first section (230) and a flexible second section (232). The first section (230) includes a first end (230A) and a second end (230B) and the second section includes a first end (232A) and a second end (232B). In one embodiment, the sections (230) (232) are permanently secured together intermediate the ends with a section connector (240) and the sections (230) (232) cooperate to form an overlapping region (234), a first non-overlapping region (236), and a second non-overlapping region (238). Further, the first end (230A) of the first section (230) is free to move relative to the first end (232A) of the second section (232), and the second end (230B) of the first section (230) is free to move relative to the second end (232B) of the second section (232). In one embodiment, the section connector (240) begins between approximately six and twenty inches from the second end of each section (230) (232) and wherein the section connector (240) directly connects less than approximately forty percent of the overlapping region (234) together.

18 Claims, 4 Drawing Sheets

| | Full-sized Sheet 228 | Queen-sized Sheet 228 | King-sized Sheet 228 | Full-sized Comforter 228 | Queen-sized Comforter 228 | King-sized Comforter 228 | Cal King-sized Comforter 228 |
|---|---|---|---|---|---|---|---|
| Length 242 | 96" | 102" | 102" | 90" | 102" | 94" | 96" |
| Width 244 | 64" | 68" | 77" | 63" | 66" | 75" | 75" |
| Width 246 | 64" | 68" | 77" | 63" | 66" | 75" | 75" |
| Width 248 | 20" | 20" | 20" | 20" | 20" | 20" | 20" |
| Width 250 | 44" | 48" | 57" | 43" | 46" | 55" | 55" |
| Width 252 | 44" | 48" | 57" | 43" | 46" | 55" | 55" |
| Width 254 | 20" | 20" | 20" | 20" | 20" | 20" | 20" |
| Length 256 | 24" | 24" | 24" | 24" | 24" | 24" | 24" |

Fig. 2C

ARTICLE OF BEDDING

BACKGROUND

A bedding set is commonly used to outfit a bed. A typical bedding set includes pillow cases, a fitted sheet, a flat sheet and one or more blankets. Unfortunately, when two people share a bed, one or both of the people may have a tendency to compete for and take some or all of the flat sheet and/or the blankets from the other person. This tendency can disrupt and interfere with the sleep of the people.

Additionally, many people allow one or more of their pets to sleep on a portion of the bed. The pets can inhibit the people from freely moving the flat sheet and/or the blankets during sleep. This also interferes with the sleep of the people.

Moreover, children with varying tastes are often forced to share a bed. Not only does competition for the flat sheet and/or the blankets disrupt sleep, the children often bicker about the color and pattern of the article of bedding.

Additionally, both children and couples often feel they need their individual space in a bed. Sharing the flat sheet and/or blankets prohibits the people from having such space. Sharing an article of bedding also prohibits the people from having their own identity.

Another common problem with sharing a flat sheet and/or blankets is the preference of one person to have the flat sheet and/or the blankets tucked into the side of the bed and the other person preferring not to. This facilitates competition for the flat sheet and/or blankets and disrupts and interferes with the sleep of the people.

In light of the above, there is a need for an article of bedding that facilitates good sleep. Further, there is a need for an article of bedding that reduces the impact of competition for an article of bedding during sleep.

SUMMARY

An article of bedding for a bed includes a flexible first section and a flexible second section. The sections are secured together and cooperate to form an overlapping region and a first non-overlapping region. Moreover, the sections are secured together so that (i) a first end of the first section is free to move relative to a first end of the second section and (ii) a second end of the first section is fixedly secured to a second end of the second section. As a result of this design, the article of bedding facilitates good sleep and reduces the impact of competition for the article of bedding during sleep.

The article of bedding can be a sheet, a blanket or another type of covering. The present invention is also directed to a bedding set, a bed combination, a method for making an article of bedding, and a method for making a bedding set.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 2C is a table that outlines the dimensions of different articles of beddings.

DESCRIPTION

Figure 1:
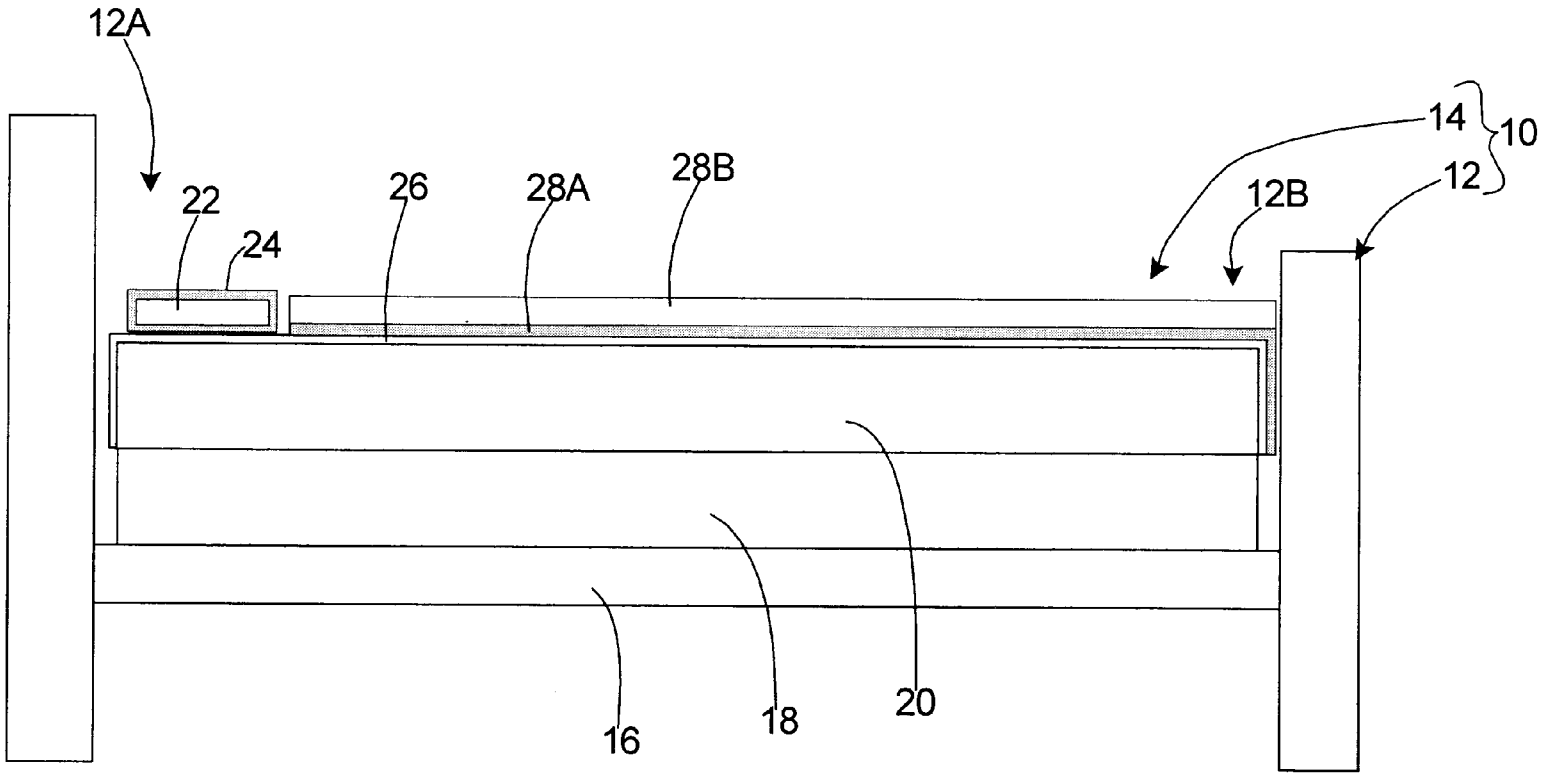
FIG. 1 is a cross-sectional illustration of a bed combination having features of the present invention.

FIG. 1 is a cross-sectional illustration of a bed combination 10 including a bed 12 and a bedding set 14. The design and components of the bed 12 can be varied. In the embodiment illustrated in FIG. 1, the bed 12 includes a bed frame 16, a box spring 18, and a mattress 20. Alternately, for example, the bed can be a waterbed or an air bed and include one or more fluid chambers (not shown). Still alternately, the bed can be a bunk type bed.

The size and shape of the bed 12 can be varied. For example, the box spring 18 and mattress 20 can each be rectangular shaped. Typical categories for sizes for a bed 12 include a single bed, a double bed, a full-sized bed, a queen-sized bed, a king-sized bed, and a Cal king-sized bed. The bed 12 includes a head end 12A and a foot end 12B.

The design of the bedding set 14 and the components in the bedding set 14 can be varied. In FIG. 1, the bedding set 14 includes one or more pillows 22, one or more pillow cases 24, a fitted sheet 26, a first article of bedding 28A and a second article of bedding 28B. Alternately, for example, the bedding set 14 can include more than two or less than two articles of beddings. In FIG. 1, the first article of bedding 28A functions as a flat sheet and the second article of bedding 28B functions as a blanket. Each article of bedding 28A, 28B can have a width and length that is greater than the width and length of the bed 12. More specifically, for example, one or both of the articles of bedding 28A, 28B can have a width and length that is at least approximately one hundred twenty percent, one hundred percent, ninety percent, eighty percent, seventy percent, or sixty percent of the width and length of the bed 12.

Figure 2A:
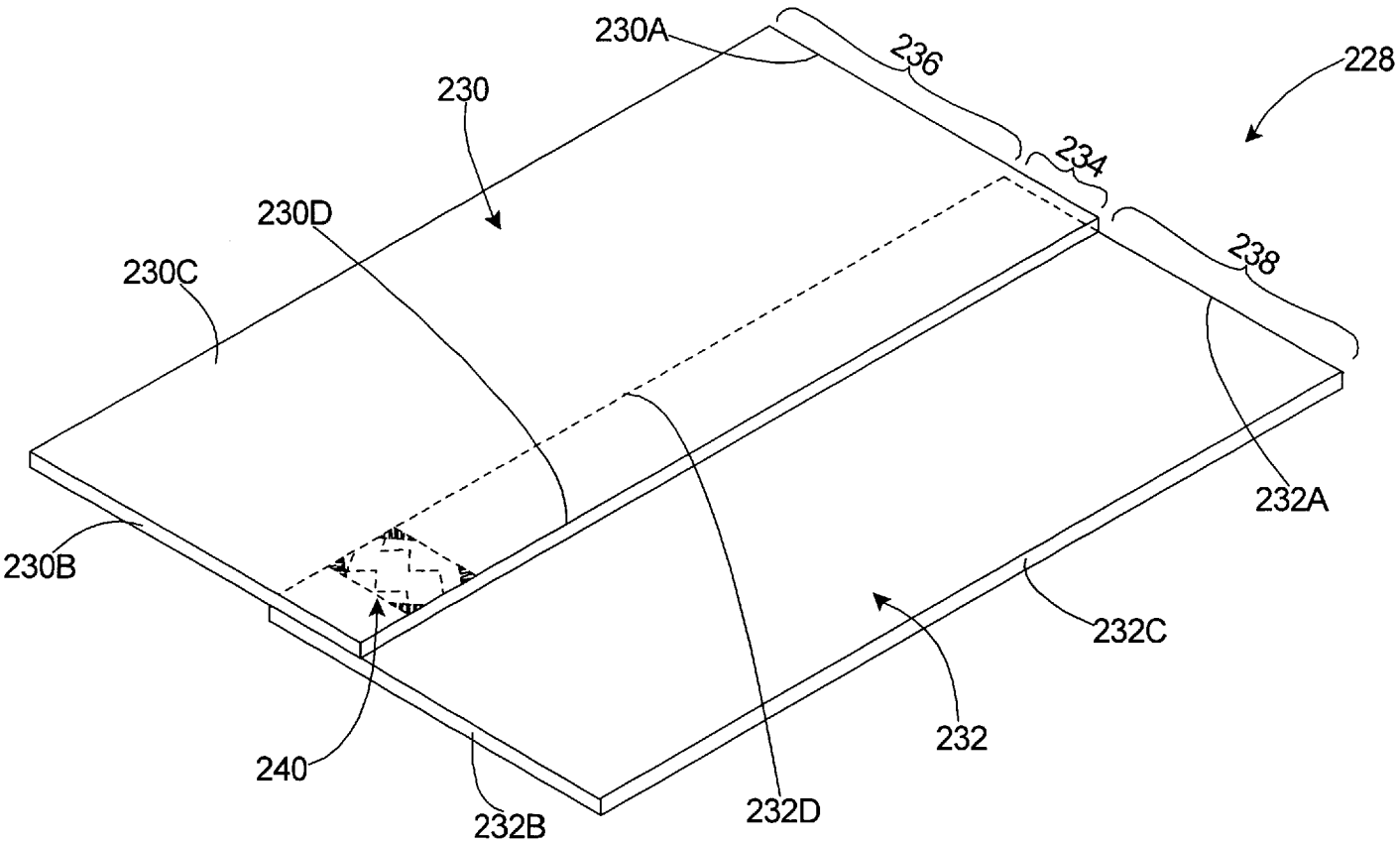
FIG. 2A is a perspective view of an article of bedding having features of the present invention.

FIG. 2A illustrates a perspective view of an article of bedding 228 having features of the present invention. The article of bedding 228 can be used as a flat sheet, a blanket, a comforter, a linen, a quilt, or another type of covering for a bed 12 (illustrated in FIG. 1). The article of bedding 228 includes a first section 230 and a second section 232 that is connected to the first section 230. Alternately, the article of bedding 228 could be designed with more than two sections 230, 232.

The size and shape of each section 230, 232 can be varied pursuant to the teachings provided herein. In FIG. 2A, the first section 230 is generally rectangular flat sheet shaped and includes a first end 230A, an opposed second end 230B, a first side 230C, and an opposed second side 230D. Somewhat similarly, the second section 232 is generally rectangular flat sheet shaped and includes a first end 232A, an opposed second end 232B, a first side 232C, and an opposed second side 232D. In FIG. 2A, the first section 230 is approximately the same size and shape as the second section 232. Alternately, for example, the first section 230 can be a different size and shape than the second section 232.

One or both sections 230, 232 can be made from a flexible material such as cloth, a woven fabric, or a quilted fabric. Suitable materials include cotton, silk, hemp, linen, flannel, polyester, or other materials. One or both sections 230, 232 can be filled with hollofil, feathers, down or another type of material. One or both sections 230, 232 can have a thread count of approximately 200, 220, 250, 310, 330, or more.

The sections 230, 232 can be made of the same material or from different materials. For example, one of the sections

230, 232 could be made of cotton while the other section 232, 230 is made of satin. The sections 230, 232 can be covered with the same pattern or different patterns. For example, the sections 230, 232 can pick up different accent colors and patterns in the bedroom. The first section 230 can match the color of the walls and the second section 232 can match the color of the curtains. Further, the article of bedding 228 can be sold as artwork. For example, the first section 230 can be black and the second section 232 can be tan for a contemporary piece. Alternately, the first section 230 can include polka dots or tractors while the second section 232 can include stripes or horses. With this design, kids, adults and/or elderly people can share a bed and have their own separate space and identity.

Additionally, one or both of the section 230, 232 can include a cord (not shown) around one or more of the edges and/or one or both sections 230, 232 can include a hem (not shown) around one or more of the edges.

The sections 230, 232 are secured together to form an overlapping region 234, a first non-overlapping region 236 and a second non-overlapping region 238. In FIG. 2A, the second side 230D of the first section 230 overlaps the second side 232D of the second section 232. Further, each region 234, 236, 238 is generally rectangular shaped.

The shape and size of each region 234, 236, 238 can be varied to suit the design requirements of the article of bedding 228. For example, the size of the overlapping region 234 can be between approximately one to twenty percent and the size of each non-overlapping region 236, 238 can be between approximately forty-nine to forty percent of the size of the article of bedding 228. As another example, the size of the overlapping region 234 can be between approximately one to ten percent and the size of each non-overlapping region 236, 238 can be between approximately forty-nine to forty-five percent of the size of the article of bedding 228. Alternately, the size of the overlapping region 234 can be greater than twenty percent and each non-overlapping region 236, 238 can be less than forty percent of the size of the article of bedding 228.

Stated another way, the size of the first non-overlapping region 236 can be at least approximately 1.5, 2, 2.5, 3, 3.5, 4, 5, 6, 10, or 20 times greater than the size of the overlapping region 234.

In FIG. 2A, the first non-overlapping region 236 is approximately the same size and shape as the second non-overlapping region 238. Alternately, for example, the first non-overlapping region 236 can be a different size and shape than the second non-overlapping region 238.

In FIG. 2A, the sections 230, 232 are secured together with a section connector 240 (illustrated as dashed line) that fixedly secures the sections 230, 232 together. In FIG. 2, the section connector 240 includes one or more threads that stitch the sections 230, 232 together. The edges of the section connector 240 can include additional, heavy stitching. Alternately, for example, the section connector 240 can include another type of fastener such as one or more rivets, or an adhesive. Still alternately, the section connector 240 can be a selective fastener, such as snaps, buttons and button-holes, and/or hook and loop type fasteners. Alternately, the sections 230, 232 can be woven and/or made together during manufacturing.

In FIG. 2A, the section connector 240 attaches the sections 230, 232 together near the second end 230B, 232B, respectively, of each of the sections 230, 232. Stated another way, the section connector 240 is positioned closer to the second end 230B, 232B, respectively, of each of the sections 230, 232 than the first end 230A, 232A, respectively, of each of the sections 230, 232. The section connector 240 can be positioned at each second end 230B, 232B or intermediate each first end 230A, 232A and each second end 230B, 232B. For example, the section connector 240 can begin between approximately six to twenty inches from the second end 230B, 232B, respectively, of each of the sections 30, 232. In FIG. 2A, the section connector 240 begins approximately eight inches from the second end 230B, 232B, respectively, of each of the sections 230, 232. Further, the section connector 240 is located in the overlapping region 234.

The amount of area of the sections 230, 232 that are directly interconnected and overlapping can be varied. For example, the section connector 240 can directly connect between approximately one percent and forty percent of the overlapping region 234. Alternately, the section connector 240 can directly connect between approximately one percent and twenty percent of the overlapping region 234. Still alternately, the section connector 240 can directly connect between approximately one percent and ten percent of the overlapping region 234. Yet alternately, the section connector 240 can directly connect between approximately one percent and five percent of the overlapping region 234.

In the embodiment Illustrated In FIG. 2A, (*i*) the first end 230A of the first section 230 is free to move relative to the first end 232A of the second section 232, and (ii) the second end 230B of the first section 230 is free to move relative to the second end 232B of the second section 232. Typically, the first end 230A, 232A of each section 230, 232 is positioned near the head end 12A of the bed 12 while the second end 230B, 232B of each section 230, 232 is positioned near the foot end 12B of the bed 12. With this design, the second end 230B, 232B of each section 230, 232 can be tucked in, while the first end 230A, 232A of each section 230, 232 is free to move independently.

Figure 2B:
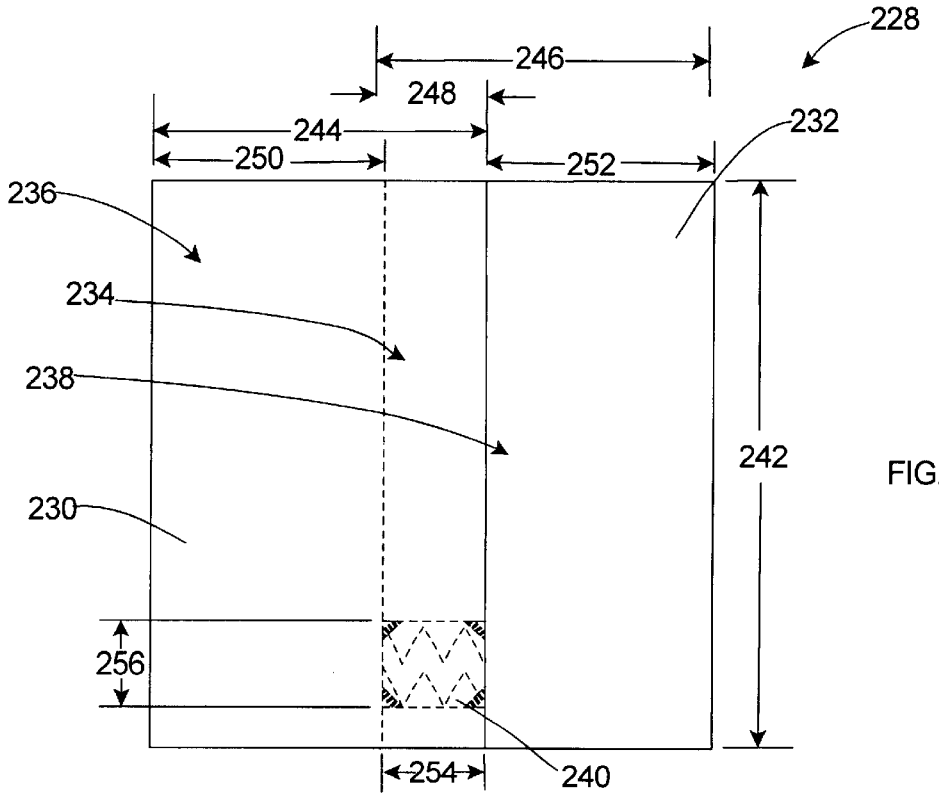
FIG. 2B is a top view of the article of bedding of FIG. 2A.

FIG. 2B illustrates a top view of the article of bedding 228 of FIG. 2A. FIG. 2B also includes (i) reference number 242 that represents the length of the sections 230, 232, and the regions 234, 236, 238, (ii) reference number 244 that represents the width of the first section 230, (iii) reference number 246 that represents the width of the second section 232, (iv) reference number 248 that represents the width of the overlapping region 234, (v) reference number 250 that represents the width of the first non-overlapping region 236, (vi) reference number 252 that represents the width of the second non-overlapping region 238, (vii) reference number 254 that represents the width of the section connector 240, and (viii) reference number 256 that represents the length of the section connector 240.

FIG. 2C is a table that outlines examples of suitable dimensions of different articles of beddings 228 that can be used with the present invention. It should be noted that other dimensions can be utilized in the articles of bedding 228. The reference numbers used in the table correspond to the reference numbers illustrated in FIG. 2B. All of the dimensions are in inches. Further, the dimensions are for the finished article with hems.

Figure 3:
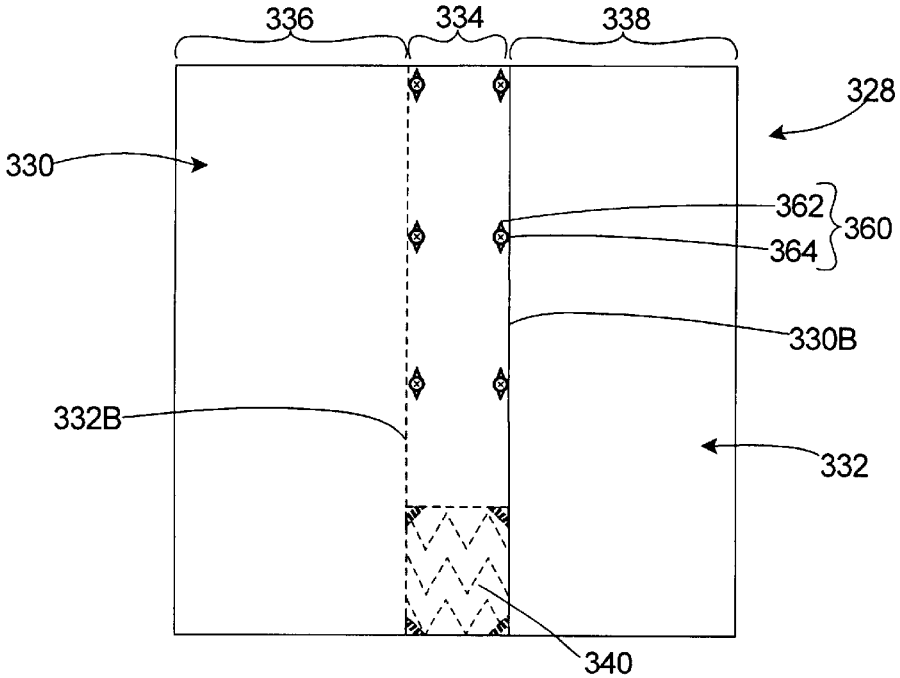
FIG. 3 is a top view of another embodiment of an article of bedding having features of the present invention.

FIG. 3 illustrates another embodiment of an article of bedding 328 that includes a first section 330, a second section 332, and a section connector 340 that are similar to the corresponding components described above. These components cooperate to define an overlapping region 334, a first non-overlapping region 336, and a second non-overlapping region 338. However, in 334 are also selectively secured together with a selective fastener assembly 360. As provided herein, the selective fastener assembly 360 can secure a portion or substantially all of the sections 330, 332 in the overlapping region 334 together. In FIG. 3, the selective fastener assembly 360 selectively secures the second side 330B of the first section 330 to the second side 332B of the second section 332 and inhibits the first end 230A of the first section 230 from moving relative to the first end 232A of the second section 232. Stated another way, the selective fastener assembly 360 allows the article of bedding 328 to function somewhat similar to prior art articles of bedding (not shown).

It should be noted that the selective fastener assembly 360 can extend the entire length of the overlapping region 334 and can eliminate the need for the second connector 340. Alternatively, the selective fastener assembly 360 can secure only a portion of the overlapping region 334 together. For example, the selective fastener assembly 360 can secure at least approximately 20, 30, 40, 50, 60, 80, or 100 percent of the overlapping region 334 together.

The design of the selective fastener assembly 360 can be varied. For example, in FIG. 3, the selective fastener assembly 360 includes (i) two rows of three spaced apart button apertures 362 that extend through the first section 330, and (ii) two rows of three spaced apart buttons 364 that are secured to the second section 332 and selectively extend through the button apertures 362.

Alternately, the selective fastener assembly 360 can include more than six or less than six buttons. Further, some or all of the buttons could be fixedly secured to the first section 330. Still alternately, for example, the selective fastener assembly can include one or more snaps, and/or hook and loop type fasteners.

Further, in FIG. 3, the section connector 340 is illustrated as beginning at the second end of each of the sections 330, 332. Alternately, for example, the section connector 340 can being away from the second end of each of the sections 330, 332.

While the article of bedding 328 as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An article of bedding for a bed, the article of bedding comprising:

a flexible first section having a first end and a second end;

a flexible second section having a first end and a second end; and a section connector that permanently connects the second section to the first section intermediate the ends, the sections cooperating to form an overlapping region, a first non-overlapping region and a second non-overlapping region, wherein the first end of the first section is free to move relative to the first end of the second section, wherein the second end of the first section is free to move relative to the second end of the second section, wherein the section connector begins between approximately six and twenty inches from the second end of each section, and wherein the section connector directly connects less than approximately forty percent of the overlapping region together.

2. The article of bedding of claim 1 wherein the size of the first non-overlapping region is at least approximately two times greater than the size of the overlapping region.

3. The article of bedding of claim 1 wherein the sections cooperate to form a flat sheet.

4. The article of bedding of claim 1 wherein the sections cooperate to form a blanket.

5. A bedding set including the article of bedding of claim 1.

6. The article of bedding of claim 1 further comprising a selective fastener assembly that selectively secures at least a portion of the sections together.

7. The article of bedding of claim 6 wherein the selective fastener assembly is positioned between the first ends and the section connector.

8. The article of bedding of claim 1 wherein the section connector directly connects less than approximately twenty percent of the overlapping region together.

9. An article of bedding for a bed, the article of bedding comprising:

a flexible first section having a first end and a second end;

a flexible second section having a first end and a second end; and a section connector that permanently connects the second section to the first section intermediate the ends, the sections cooperating to form an overlapping region, a first non-overlapping region and a second non-overlapping region, wherein the first end of the first section is free to move relative to the first end of the second section, wherein the second end of the first section is free to move relative to the second end of the second section, wherein the section connector begins between approximately six and twenty inches from the second end of each section, wherein the section connector directly connects less than approximately forty percent of the overlapping region together, and wherein the size of the first non-overlapping region is greater than the size of the overlapping region.

10. The article of bedding of claim 9 wherein the size of the first non-overlapping region is at least approximately two times greater than the size of the overlapping region.

11. The article of bedding of claim 9 wherein the sections cooperate to form a flat sheet.

12. The article of bedding of claim 9 wherein the sections cooperate to form a blanket.

13. A bedding set including the article of bedding of claim 9.

14. The article of bedding of claim 9 further comprising a selective fastener assembly that selectively secures at least a portion of the sections together.

15. The article of bedding of claim 14 wherein the selective fastener assembly is positioned between the first ends and the section connector.

16. The article of bedding of claim 9 wherein the section connector directly connects less than approximately twenty percent of the overlapping region together.

17. A method for making an article of bedding for a bed, the method comprising the steps of:

providing a flexible first section having a first end and a second end;

providing a flexible second section having a first end and a second end; and permanently connecting the second section to the first section with a section connector, the sections cooperating to form an overlapping region, a first non-overlapping region and a second non-overlapping region, wherein the first end of the first section is free to move relative to the first end of the second section, wherein the second end of the first section is free to move relative to the second end of the second section, wherein the section connector begins between approximately six and twenty inches from the second end of each section, and wherein the section connector directly connects less than approximately forty percent of the overlapping region together.

18. The method of claim 17 further comprising the step of selectively securing a portion of the overlapping region together.

* * * * *